United States Patent [19]

Siminoff

[11] 4,278,002

[45] Jul. 14, 1981

[54] FAST-WIND TUNING MACHINE FOR STRINGED MUSICAL INSTRUMENT

[76] Inventor: Roger H. Siminoff, 112 Privada Luisita, Los Gatos, Calif. 95030

[21] Appl. No.: 71,732

[22] Filed: Aug. 31, 1979

[51] Int. Cl.[3] ..... G10D 3/14; G10D 7/00; G05G 1/10

[52] U.S. Cl. ..... 84/304; 84/458; 74/547

[58] Field of Search ..... 84/200–208, 84/304–306, 454–455, 458–459; 74/547, 550

[56] References Cited

U.S. PATENT DOCUMENTS

| | | | |
|---|---|---|---|
| 490,494 | 1/1893 | Olsen | 84/304 |
| 762,723 | 6/1904 | Hutchins | 84/304 X |
| 2,165,060 | 7/1939 | Krug | 74/547 |
| 2,812,682 | 11/1957 | Longone et al. | 84/458 |
| 3,061,222 | 10/1962 | Beach | 74/547 X |
| 3,706,254 | 12/1972 | Morin | 84/458 |
| 4,031,774 | 6/1977 | Bennett | 74/547 |

*Primary Examiner*—L. T. Hix
*Assistant Examiner*—Thomas H. Tarcza
*Attorney, Agent, or Firm*—Gottlieb, Rackman & Reisman

[57] ABSTRACT

A handle to facilitate more rapid winding/or unwinding of a string of a musical instrument is disclosed. The handle replaces the usual knob, and includes a crank member which can be pivoted out from a concealed storage position to an operative extended position, thereby achieving a greater radius of rotation and a resultant fast-wind capacity for the device.

11 Claims, 4 Drawing Figures

FIG. 2
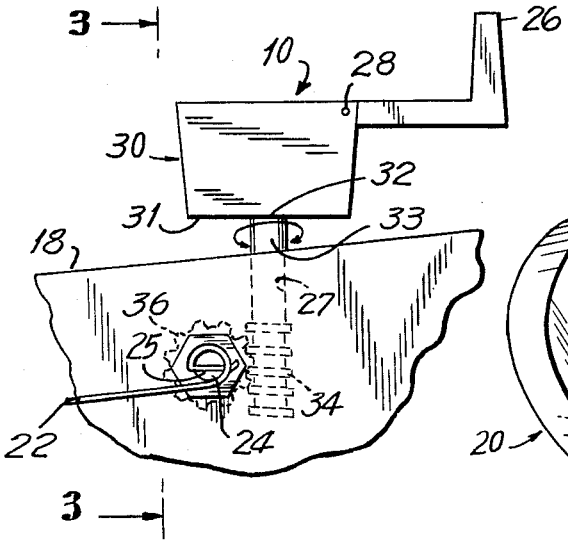
FIG. 1
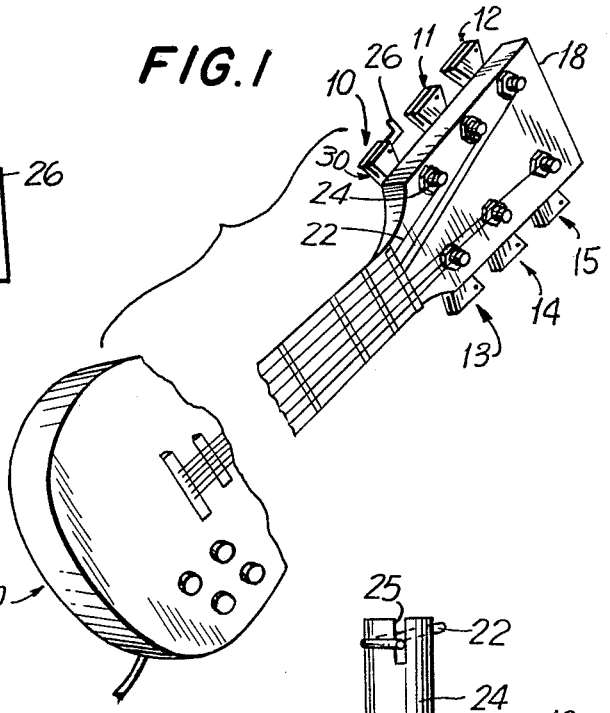
FIG. 3
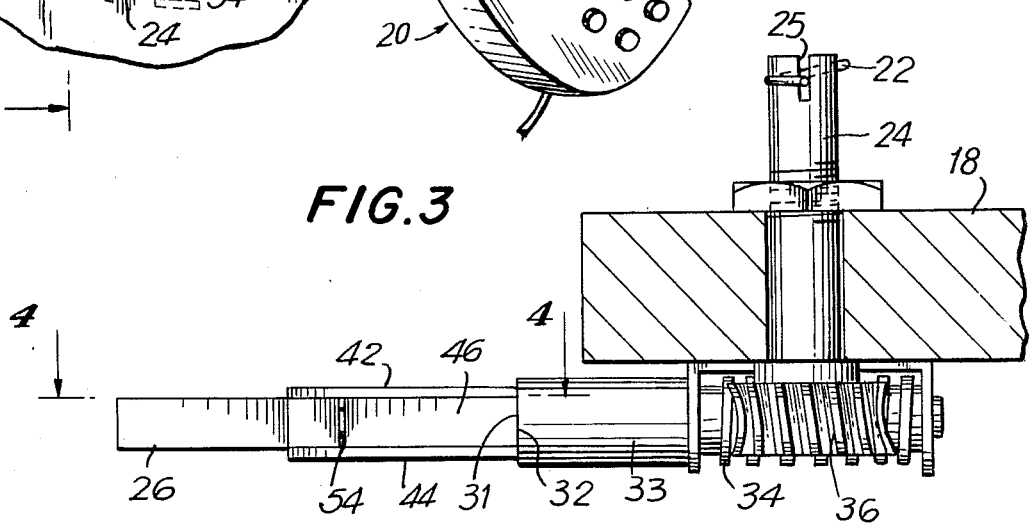
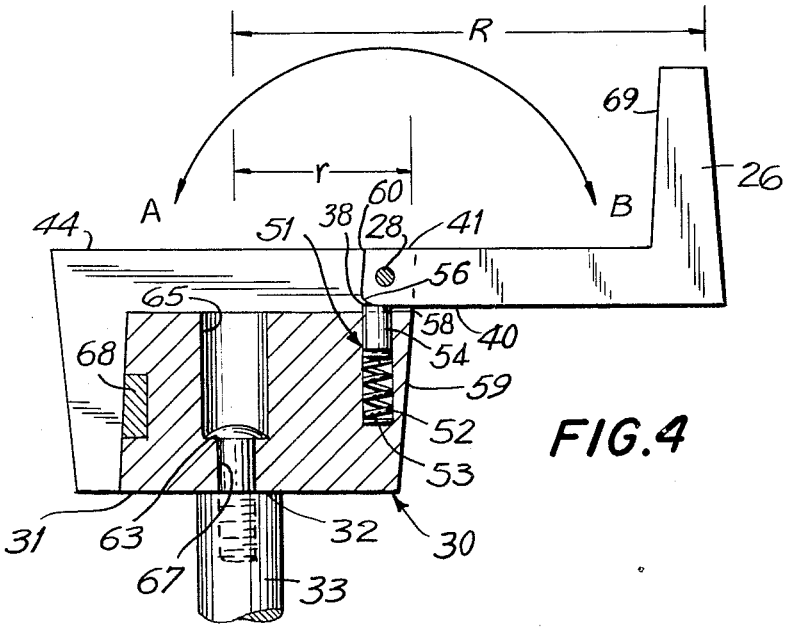
FIG. 4

FAST-WIND TUNING MACHINE FOR STRINGED MUSICAL INSTRUMENT

This invention relates to stringed musical instruments, and more particularly, to a winder-crank forming part of a fast-wind assembly to replace each of the conventional knobs on the tuning machines of a stringed instrument.

In common usage, when a musician encounters a broken or malfunctioning string, thus necessitating a string change, he faces a slow and tedious process. If the old string is intact, it must be fully unwound before the new one can be installed. After selecting the new string, even if cut to an appropriate length, there is still considerable slack which must be eliminated by winding the string onto the string tumbler by the conventional winding knob. Typical winding knobs are flat or disc-shaped and require a twisting motion of the thumb and forefinger. This is a slow process which may interfere with the musician's performance.

For many years, crank-type tools have been available to facilitate a somewhat easier twisting motion, thereby accelerating tightening or loosening the strings while they are being changed. Such tools have included handles rotatable relative to an arm, and an underlying receptacle to receive and grip the knob of a tuning machine; the composite assembly is then turned, thereby tightening or loosening a selected string. However, the typical crank-tool heretofore available is not integral with the instrument, but, instead, is a separate component, which necessarily results in all of the inconveniences of relying upon an additional device which can be either lost or broken and which requires additional and separate storage. Furthermore, such an external device may come loose during usage and may also cause unsightly and damaging abrasion to the instrument where applied. In addition, such prior art "add-on" fast-wind devices are cumbersome and often unwieldy, and detract from the overall modern and pleasing appearance of the contemporary devices to which they are applied. They are also impractical to store for usage during professional or on-stage performances.

It is therefore an object of this invention to obviate one or more of the aforesaid difficulties.

It is another object of this invention to provide the instrumentalist with a string-tightening device which may be attached to or replace a typical tuning machine.

It is a further object of this invention that a fast-wind device be fully substitutable for conventional tuning machines of an instrument, for example, by replacing all tuning machines in the case of either a six-string or twelve-string instrument.

It is still another object of this invention to provide a winder-crank which may be conveniently positioned with respect to a stringed instrument's tuning machine.

It is an additional object of this invention to provide fast-wind devices of pleasing appearance wherein the winder-crank is hidden when in its stored position.

Additional objects and advantages of this invention will become apparent when considered in conjunction with one particular illustrative embodiment of the invention, wherein a fast-wind tubing machine includes a knob which is coupled to a winder shaft of a tuning machine of a stringed musical instrument, such as a guitar. Coupled to the knob is an extension means to effectively extend the radius of rotation of the knob. The extension means may include a crank, the crank being pivotally connected to the knob so as to be movable from a concealed storage position to an operative position whereby the crank projects out from the knob so as to create an extended lever arm. The resultant extended lever arm effectively comprises approximately double the moment arm of the frame alone.

In the winder-crank's extended position, the instrumentalist has the ability of rotating the fast-wind device with a continuous circular motion. Thus, a greater speed of circumferential winding is obtained for the same amount of force as was previously exerted in turning the prior art devices. With the present invention, continuous rotary motion and the greater lever action and torque resulting from extending the moment of the frame to include the winder-crank, combine to generate a salutary result for the user.

It is therefore a feature of an embodiment of this invention that a knob is attached to a conventional tuning machine in replacement of a conventional knob on the tuning machine of a stringed instrument.

It is a further feature of an embodiment of this invention that a winder-crank is integrally incorporated into a knob of a tuning machine of a stringed instrument to facilitate rapid winding or unwinding of a string.

It is another feature of an embodiment of this invention that the winder-crank may be selectively stored in a hidden position or pivoted into an open position.

It is still another feature of an embodiment of this invention that the winder-crank is retractable into a knob of commonly acceptable size and shape in stringed musical instruments.

It is yet another feature of an embodiment of this invention that a winder-crank provides increased mechanical advantage and leverage during tuning.

It is also a feature of an embodiment of this invention that the winder-crank stays open with the aid of a spring-loaded device that urges the winder-crank into an open position.

It is yet another feature of an embodiment of this invention that the winder-crank remains in its retracted position with the aid of a magnet.

Additional objects, features and advantages of the present invention will become apparent when considered in conjunction with a presently preferred, but nonetheless illustrative, embodiment of the invention as explained in the following detailed description and as shown in the accompanying drawing wherein:

FIG. 1 is a perspective view of a musical instrument incorporating an embodiment of this invention for each tuning machine, with one such embodiment being shown in the extended fast-wind position;

FIG. 2 is an enlarged fragmentary plan view of a portion of the peg-head end of the instrument of FIG. 1, illustrating a knob coupled to a winding shaft and with its winder-crank extended for fast-wind use;

FIG. 3 is a partial cross-sectional view taken along plane 3—3 of FIG. 2 in the direction of the arrows, showing the invention interconnected with a worm gear assembly of a typical tuning machine of the musical instrument; and FIG. 4 is a partial cross-sectional view of the unit, taken along the plane 4—4 of FIG. 3 in the direction of the arrows, showing the winder-crank's coupling to the knob and indicating the pivotal movement of the winder-crank between the closed and extended positions.

The drawings illustrate the invention in connection with a conventional six-string guitar, although it will be appreciated that the invention is applicable to a variety of stringed musical instruments, including banjos, mandolins, ukuleles, violins and the like. The main components of the invention, to be described hereinafter, are a knob, hinge pin, winder-crank, spring, magnet and winder shaft. The overall invention is illustrated in use in FIG. 1, where six fast-wind assemblies 10–15 are shown attached to the neck end piece 18 of a guitar 20, which includes six strings 22 connected to respective slotted string-retaining shafts 24. For each string 22 and retaining shaft 24, there is also a corresponding winding handle or crank 26 attached by pin 28 to a knob 30, which assembly replaces the conventional knob (not shown). Knob 20 may be of any reasonable shape, althought the embodiment shown in FIGS. 1–4 is trapezoidal in appearance. Other illustrative shapes may also include rounded upper corners, for example.

Knob 30 is centrally mounted at its base 31 (FIG. 2) to the top 32 of a winder shaft 33. This arrangement is particularly advantageous because the crank 26, when extended as shown in FIGS. 2 and 4, facilitates easy rotary motion, resulting in rapid winding with less effort and greater speed. In the normal retracted position, as illustrated by assemblies 11–15 shown in FIG. 1, the winder-crank 26 is totally unobtrusive such that the knob 30 operates and appears as an ordinary knob in the conventional manner.

As also shown in FIG. 2, winder shaft 33 extends into the shaft channel 27 of the neck end piece 18 and terminates in a typical threaded worm element 34 which engages a typical rotary gear element 36 at the base of the string retaining shaft 24; the winder shaft 33 translates the cranking action exerted on the winder-crank 26 to rotatable shaft 24, whereby the tension in string 22 may be adjusted.

The crank 26 may be pivoted in the direction of arrowhead B, as seen in FIG. 4, 180° in a clockwise direction out of the closed position; once such pivoting action has been manually commenced and reaches approximately 135° of rotation, crank 26 is urged into the open position by the action of the spring-lock assembly 51. Spring assembly 51 is comprised of a helically coiled spring 52 attached to a deadweight 54 and seated in a housing space 53. Upper wall 38 of deadweight 54 is urged against the adjoining section of surface 40 of winder-crank 26 to resist counter-clockwise rotation of the crank in the direction of arrowhead A, since crank 26 is then in the extended or operative position. Edge 58 of side wall 59 of frame 30 resists further rotation of crank 26 in the direction of arrowhead B beyond the desired 180° clockwise arc. When the winder-crank 26 is in the closed position, wall 38 of dead-weight 54 is urged against opposite surface 41 of winder-crank 26 to resist inadvertent clockwise rotation of the crank in the direction of arrowhead B, since the crank will then be in the storage or inoperative position.

Corner 56 of winder-crank 26 is rounded to facilitate selective rotation of the winder-crank in both the clockwise and counter-clockwise directions, deadweight 54 being driven toward and variably compressing spring 52 during such rotation. But adjacent corner 60 of the winder-crank is squared rather than rounded, thus necessitating the exertion of a greater force to accomplish clockwise rotation of said winder-crank from the storage position than would be required if corner 60 were also rounded as is corner 56. Such greater force is desired as a precaution against inadvertent and undesired rotation of the winder-crank in the direction of arrowhead B as seen in FIG. 4. A further precaution against this unwanted rotation may be provided by the inclusion of magnet 68, which forcibly urges crank 26 to remain in the closed position by means of the magnetic attraction of the ferro-metallic wall 69 of crank 26 in the direction of magnet 68.

The connection of knob 30 to the underlying operative elements is achieved by coupling knob 30 to winder shaft 33 by means of screw 63. This screw is inserted into bore 65 and extends through bore 67 so that it may be threadedly engaged with winder shaft 33. Screw 63 and its bores 65 and 67 are contained within front wall 42 and back wall 44 of knob 30, shown in FIG. 3 as they are joined by side wall 46.

In typical operation, when an instrumentalist chooses to replace a string, he must first twist the string around the string retaining shaft 24, and then lock it into a provided slot 25 in the shaft 24, which still leaves considerable slack in the string. With winder-crank 26 in the extended fast-wind position (see FIG. 4), the normal radius of rotation "r" of the knob is effectively increased to "R", almost double the radius of rotation of the knob with the winder-handle in the closed position. Thus, the instrumentalist may now rapidly take up the slack in the string by grasping the winder-crank and rotating it in a clockwise or counter-clockwise direction as desired. This rotation is transmitted by shaft 33 to worm threads 34 which in turn translate such rotation to gear 36; rotation of this gear translates this winding action to string 22 by means of retaining shaft 24. The string is thus wound until a desired tension is achieved. Thereafter, the instrumentalist pivots the winder-crank 26 about pin 28 in the direction of arrowhead A in FIG. 4, reaching the stored position such that winder-crank 26 may no longer be seen. The invention thereafter assumes the appearance and function of an ordinary peg as illustrated by elements 11–15.

When the winder-crank is in this stored position, upper wall 38 of deadweight 54 transmits the spring action of helically coiled spring 52 to the side wall 41 of said winder-crank. This urges the winder-crank to remain in the closed position. When it is desired to rotate the crank out of the closed position, the action of the spring assembly 51 against side wall 41 is such that extension of the winder-crank is resisted; corner 60 is squared to maximize the force required to extend the winder-crank. In addition, extension of winder-crank 26 may be further resisted by incorporating magnet 68 into knob 30, such that wall 69 of a preferred ferro-metallic embodiment of crank 26 will be held by the attractive forces of magnet 68 whenever, upon the complete rotation of crank 26 into the closed position, wall 69 abuts magnet 68. Therefore, the instrumentalist must intentionally apply sufficient force to rotate the winder-crank into the extended position. This prevents unwanted extension of the winder-crank and maintains the invention in a neat and compact appearance.

With the winder-crank in the extended position, the spring assembly 51, acting upon side wall 40 of winder-crank 26, urges the winder-crank to remain in the extended position. The crank may be returned to the stored position by rotating it in a counter-clockwise direction as shown by arrowhead A in FIG. 4. The effort required to overcome the tension of the spring is less now than is required when extending the winder-crank. This reduced effort is achieved by the rounding of corner 56 as opposed to the squaring of corner 60, and the absence of magnetic attraction corresponding to that between wall 69 and magnet 68.

It is to be understood that the above-described embodiments are merely illustrative of the application of the principles of this invention. Numerous variations may be devised by those skilled in the art without departing from the spirit or scope of the invention.

What is claimed is:

1. Apparatus to facilitate rapid winding or unwinding of a string of a musical instrument comprising in combination, tuning machine means for normally providing tension to said string, said tuning machine means including string retaining means for holding said string, shaft means cooperatively coupled to said string retaining means for movement therewith and knob means connected to said shaft means for applying torque thereto, and crank means integral with said tuning machine means and pivotally connected to said knob means for selectively extending the radius of rotation of said knob means with respect to said shaft means.

2. Apparatus in accordance with claim 1 wherein said crank means includes a winder-handle, and further including hinge means for pivotally connecting said winder-handle to said knob means.

3. Apparatus in accordance with claim 2 wherein said hinge means includes a pin.

4. Apparatus in accordance with claim 1 wherein said crank means includes a winder-handle to be selectively positioned in either a closed position within said knob means or an open position projecting outwardly from said knob means.

5. Apparatus in accordance with claim 4 wherein said tuning machine means further includes spring assembly means for resiliently urging said winder-handle to remain in the selected extended position.

6. Apparatus in accordance with claim 5 wherein said spring assembly means includes a housing chamber, a spring within said chamber and a deadweight abutting said spring and in contact with said winder-handle to urge said winder-handle toward said open position and to resist movement of said winder-handle toward said closed position.

7. Apparatus in accordance with claim 4 wherein said tuning machine means further includes magnetic means for attractively urging said winder-handle to remain in said closed position.

8. Apparatus in accordance with claim 7 wherein said winder-handle includes a ferro-metallic component.

9. Apparatus in accordance with claim 5 wherein said tuning machine means further includes means defining a force-fitting relationship between said knob means and said winder-handle to retain said winder-handle in said closed position

10. Apparatus to facilitate rapid winding or unwinding of a string of a musical instrument comprising in combination, tuning machine means for normally providing tension to said string, said tuning machine means including string retaining means for holding said string, shaft means cooperatively coupled to said string retaining means for movement therewith and knob means connected to said shaft means for applying torque thereto, and extension means integral with said tuning machine means for effectively extending the radius of rotation of said knob means with respect to said shaft means.

11. Apparatus in accordance with claim 10 further including coupling means for pivotally connecting said extension means to said knob means.

* * * * *